United States Patent [19]

Mouat et al.

[11] Patent Number: 4,579,391

[45] Date of Patent: Apr. 1, 1986

[54] METHOD OF ELECTRIC SMELTING TO MATTE IN SITU

[76] Inventors: William G. Mouat, 805 First Bank Bldg.; Marvin D. Mouat, 802 Lewis Ave., both of Billings, Mont. 59101

[21] Appl. No.: 660,406

[22] Filed: Oct. 12, 1984

[51] Int. Cl.[4] ..... E21C 41/14

[52] U.S. Cl. ..... 299/6; 299/4; 299/8; 299/14; 166/248

[58] Field of Search ..... 299/3, 4, 6, 8, 14; 166/50, 60, 248; 219/277, 278; 423/27

[56] References Cited

U.S. PATENT DOCUMENTS

| | | | |
|---|---|---|---|
| 1,759,456 | 5/1930 | Hofseth | 299/6 X |
| 1,993,641 | 3/1935 | Aarts et al. | 175/16 |
| 2,761,829 | 9/1956 | Dolloff | 299/6 X |
| 2,953,353 | 9/1960 | Allen | 175/16 |
| 3,254,921 | 6/1966 | Halsey | 299/4 X |
| 3,988,036 | 10/1976 | Fisher et al. | 299/4 X |

FOREIGN PATENT DOCUMENTS

| | | | |
|---|---|---|---|
| 754047 | 8/1980 | U.S.S.R. | 299/6 |

*Primary Examiner*—George A. Suchfield
*Attorney, Agent, or Firm*—Harvey B. Jacobson

[57] ABSTRACT

A method of extraction of metallic sulfides (Matte) from an ore deposit in situ. The contained sulfides are smelted by resistor induced heat creating a matte containing precious metals, including, but not limited to, platinum-group metals and gold and silver (as well as copper, nickel, iron, sulfur, etc). The heavier portion of the bath (matte) settles to the bottom and the slag rises to the top. Further smelting is controlled by positioning of the electrode pairs in the bath, thus regulating heat generation by modulation of the resistance between said electrodes. Placement of the electrodes in cased drill holes strategically placed to intersect and penetrate the ore-bearing horizons results in extraction of the valuable metals as matte. The matte can be recovered either as a liquid, or, after cooling, as a solid.

4 Claims, 2 Drawing Figures

METHOD OF ELECTRIC SMELTING TO MATTE IN SITU

BACKGROUND OF THE INVENTION

1. Field of the Invention

The present invention generally relates to separation of heavy, metals from an ore or natural occurrence of mineralized material such as olivine, peridotite and the like and more specifically, the invention involves a process for electric smelting to matte in situ by heating the mineralized material in its natural formation and, if necessary, adding a flux or fluxing electrolyte to convert it to a molten state with gravitational forces together with fluxing caused by sulphides or other fluxing materials, natural or induced, enabling heavier and precious metals such as platinum, palladium, copper, nickel and the like to concentrate at the lower portion of the molten metal thereby enabling recovery of the matte for subsequent treatment 2. Description of the Prior Art Various patents exist in which heat is utilized in association with natural formations of rock, minerals and the like. However, the prior patents do not disclose the basic concepts or specific process of the present invention. The following prior U.S. Pat. Nos. 1,719,257 July 2, 1929; 1,898,926 Feb. 21, 1933; 1,993,641 Mar. 5, 1935; 2,953,353 Sept. 20, 1960; 3,493,060 Feb. 3, 1970; 3,907,044 Sept. 23, 1975; 3,988,036 Oct. 26, 1976; 4,376,598 Mar. 15, 1983 are relevant to this field of endeavor.

SUMMARY OF THE INVENTION

An object of the present invention is to provide a process for electric smelting to matte in situ for separating heavy metals from other material in a mineral containing ore or other naturally occurring mineralized material by in situ thermal concentration of the heavier precious metals.

Another object of the invention is to provide a process in accordance with the preceding object which includes the steps of drilling and casing a plurality of holes or bores into the formation of mineralized material and inserting in each hole an apparatus capable of conducting current to the surrounding mineralized material to melt the material and convert it to a molten state.

A further object of the invention is to provide a process in accordance with the preceding objects in which the electrically energized apparatus is a carbon rod or the like for maintaining the melted material in a molten state so that gravitational effect of the heavy metals together with the fluxing effect of sulphides or other fluxes causes the heavier metallic substances to sink to the bottom of the melted material so that the matte can be recovered either as a liquid or, after cooling, as a solid.

Still another object of the invention is to provide a process for in situ thermal concentration of minerals which can be easily practiced with various types of naturally occurring formations and which efficiently enables concentration and separation of heavier metallic materials.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
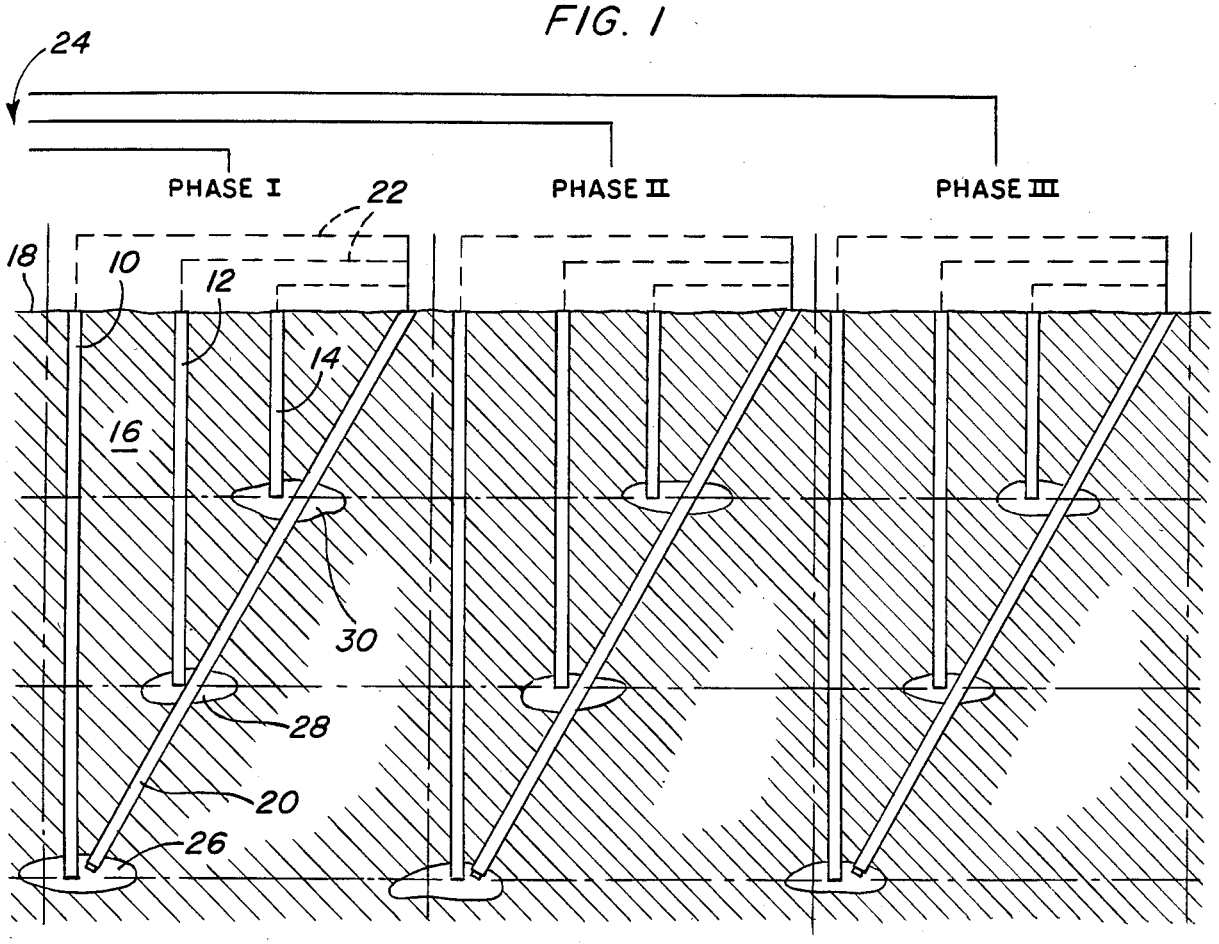
FIG. 1 is a schematic longitudinal section of a vein illustrating the recovery method of a vein of ore of the present invention.

Referring now specifically to the drawings, the method or process of the present invention requires the drilling or otherwise forming a plurality of drill holes or bores 10, 12 and 14 downwardly into an ore vein or natural occurrence of mineralized material 16 located at a predetermined distance below ground surface 18 with the presence and specific location of the ore vein 16 being determined by existing well known procedures not forming part of this invention. Each of the drill holes may be provided with a casing in a well known manner. An inclined drill hole 20 which may also be cased is oriented in intersecting relation to the bottom of the bores 10, 12 and 14. A carbon rod or other device or apparatus capable of conducting electrical current is inserted into each of the bores with the carbon rod being electrically energized through conductors 22 from a single phase or muli-phase power source 24. Suitable control apparatus of conventional construction is provided by which the carbon rods may be energized to conduct current to the surrounding mineralized substances or materials in the ore vein 16 to a temperature which will form a matte of the metals in the mineralized materials or substances in a molten state with the matte being retained in its molten state while it migrates to and collects in reservoirs or collecting areas 26, 28 and 30 with the gravitational effect of heavy metals and the fluxing effect of sulphides serving to form the matte. Access may be provided to the matte and may be in the form of a pipe extending into the matte and connected to a suitable mechanism for pumping or tapping the matte for removing the matte that would have a substantial quantity of heavy metals including precious metals, such as platinum and palladium, and the metals such as copper, nickel and the like.

Other means may be provided for providing an access way for tapping and removing the matte that would contain metals and precious metals such as platinum, palladium, copper, nickel and the like. Also, the molten material may be allowed to cool and be recovered.

Figure 2:
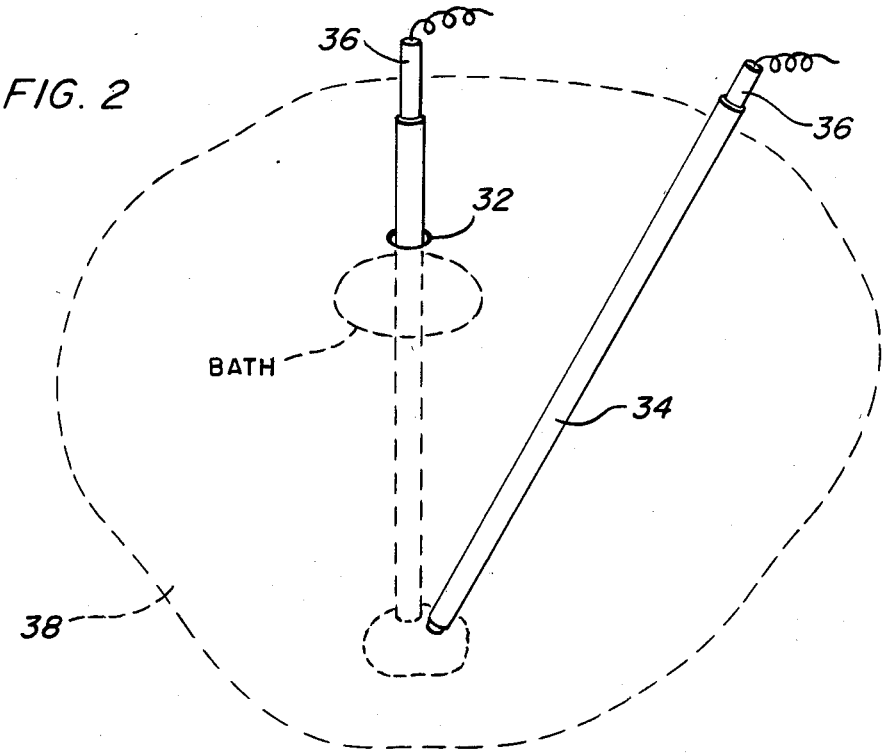
FIG. 2 is a schematic cross section (or longitudinal section) of a vein of ore illustrating an alternate recovery method of the present invention.

FIG. 2 illustrates an alternative method in which intersecting bores 32 and 34 each have an electrically energized carbon rod 36 or equivalent apparatus for conducting electrical current to the surrounding material causing it to melt. The rods 36 may have a variable conducting capacity and are connected with conventional controls to enable the conducting characteristics of the conducting rods or other devices used in lieu thereof to adjust the temperature of the conducting device and correspondingly the temperature of the surrounding mineral material 38 which may be any of various naturally occurring mineralized materials such as olivine, peridotite and the like. The metals are separated from the gangue to form the matte by gravitational effect of metals in the bath together with the fluxing effect of sulphides such as copper sulphide and nickel sulphide which naturally occur in various metal ores or which can be injected if desired with the fluxing effect and gravitational effect serving to efficiently enable concentration of the metals in the bath at the lower portion of the bores 32 and 34.

The rod 36 heats by conduction and is used primarily in recovering high and/or varying melting point metals and uses either naturally occurring or injected fluxing materials such as copper sulphide, nickel sulphide, limestone, silica and the like which naturally occur in many mineral ores or mineral materials but which can be added if necessary with the introduction of such materials providing conductivity necessary for the continuity of the current required to obtain and maintain continuous melt of the entire matrix so that the molten material, with the metals gravitating to the bottom of the bath so that the heavier metal can be removed for concentration and further refining for later use. When tapping or recovering the metals, the sulphides, either those naturally occurring in the ore or possibly added sulphides such as copper and/or nickel sulphides are also recovered for reuse. The sulphides produce a fluxing effect and provide the conductivity necessary for the continuity of the heat required to obtain continuous melt of the entire matrix. Various procedures may be provided for tapping and removing the matte which may be permitted to cool somewhat prior to removal.

The three phase arrangement illustrated in FIG. 1 enables different volumes of matte to be removed from the reservoirs 26–30 in each phase with the conducting rods in the bore 20 and bores 10–14 being selectively and sequentially energized.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. The process for electric smelting of mineral formations to matte in situ comprising the steps of drilling at least two holes downwardly into a vein of a mineral formation, inserting conducting devices in said holes with the conducting devices being capable of conducting current to mineralized material between the conducting devices, forming a bath of molten material comprising a slag on top and a matte at the bottom, and removing the matte.

2. The process as defined in claim 1 wherein the step of drilling at least two holes includes the step of drilling a plurality of intersecting holes into the vein and the step of inserting a conducting device includes the step of inserting an elongated electrically energized carbon rod or other conducting device in each of said holes for conducting current to the surrounding mineral formation in each hole to matte, and introducing, a fluxing material to start or expedite the melting process matte to be collected in a reservoir.

3. The process as defined in claim 2 wherein the step of tapping and removing metals includes the step of providing an access way to the matte, enabling the removal of the matte.

4. The process of recovering matte containing metals such as platinum, palladium, copper and nickel from a vein consisting of the steps of:

(a) drilling a plurality of holes downwardly into a subterranean occurrence of mineralized material;

(b) inserting electrically energized rod-type conducting apparatus into each hole;

(c) energizing the conducting apparatus sufficiently to melt the surrounding mineralized substance to convert the same to a matte and gangue; and (d) removing the matte from the bottom of the melt.

* * * * *